United States Patent [19]

Newcombe, Jr.

[11] 4,413,734

[45] Nov. 8, 1983

[54] MULTIPLE COMPONENT FILM PACKAGE

[75] Inventor: Elliott H. Newcombe, Jr., Charlotte, N.C.

[73] Assignee: Atlantic Coast Carton Company, Charlotte, N.C.

[21] Appl. No.: 407,259

[22] Filed: Aug. 11, 1982

[51] Int. Cl.[3] ..... B65D 5/56; B65D 5/32

[52] U.S. Cl. ..... 206/455; 229/9; 229/19; 229/23 R

[58] Field of Search ..... 206/455, 389, 316; 229/9, 19, 44 CB, 23 R, 23 BT, 23 AB

[56] References Cited

U.S. PATENT DOCUMENTS

| | | | |
|---|---|---|---|
| 1,998,716 | 4/1935 | Guyer | 229/19 |
| 2,071,110 | 2/1937 | Burke | 206/455 X |
| 2,202,280 | 5/1940 | Wilson | 229/44 CB |
| 2,274,278 | 2/1942 | Sanders | 206/455 X |
| 2,335,107 | 11/1943 | Ciringione | 206/455 |
| 2,776,081 | 1/1957 | Ringler | 229/9 |
| 3,834,607 | 9/1974 | Muylle | 229/23 BT |
| 4,257,317 | 3/1981 | Yoshida et al. | 493/59 |
| 4,331,236 | 5/1982 | Bauer | 206/455 |

*Primary Examiner*—William Price
*Assistant Examiner*—Bryon Gehman
*Attorney, Agent, or Firm*—Bell, Seltzer, Park & Gibson

[57] ABSTRACT

A box formed of inner and outer folding carton components which are joined together to provide a protective storage and dispensing box for flexible sheets of light-sensitive material, such as X-ray film sheets and the like. The inner box component is of a cheaper grade of heavier weight material than the outer box component and extends upwardly beyond the upper edge of the outer box component to provide support for a cap-type cover. The box components are constructed and assembled to provide rigidity and to exclude light from the interior of the box, and to expedite removal of the film from the box.

8 Claims, 14 Drawing Figures

MULTIPLE COMPONENT FILM PACKAGE

FIELD OF THE INVENTION

This invention relates to a protective storage and dispensing box for flexible sheets of light-sensitive material, such as X-ray film sheets and the like.

BACKGROUND OF THE INVENTION

It is generally known to package sheets of light-sensitive material, such as X-ray and photographic film in a cardboard box. In most instances the box is formed with inner and outer box components and the inner box component extends upwardly above the upper edge of the outer box component and is provided with a cap-type cover so that the box may serve as a dispenser for removing individual sheets of the light-sensitive material from the box. However, the known boxes of this type have been constructed of heavy cardboard material and are therefore expensive to produce. In many cases these heavy cardboard boxes are covered with an overwrap in order to prevent entry of light into the interior of the box and this also adds to the expense and weight of the box. In an attempt to reduce the cost of such boxes, it has been proposed that the boxes be made of a lighter weight cardboard material. However, when this has been attempted, it has been found that the box does not have sufficient rigidity to properly protect the film packaged therein.

SUMMARY OF THE INVENTION

It is an object of the present invention to provide a protective storage and dispensing box for film and the like which is formed of inner and outer folding carton components joined together to provide a rigid set-up box having a relatively light overall weight. The box is constructed and assembled to exclude light from the interior thereof and to expedite removal of the film sheets therefrom. The inner box component or liner is formed of a relatively heavy-weight chipboard while the outer box component or wrap is formed of a relatively light-weight cardboard. The manner in which the panel components are overlapped and secured together at the sides and bottom of the inner and outer box components provides protection against damage to the box and the entry of light into the interior of the box.

In accordance with the present invention, the bottom panels of the inner box component are overlapped in one direction and the bottom panels of the outer box component are also overlapped and secured together in the same direction so that the bottom panels are alternately joined by fold lines to the respective front and rear panels of the inner and outer box components to provide a sinuous path for any light entering the box through the bottom to thereby aid in excluding light from the interior of the box. The inner and outer box components are also provided with overlapped side panels and the overlapped side panels of the inner box component extend along one side of the film sheets while the overlapped side panels of the outer box component extend along the opposite side of the film sheets to add rigidity to the film box and to aid in excluding light from the interior of the box.

The inner box component is constructed to closely fit and slip within the outer box component and the box components are joined by adhesive positioned between the front and rear panels of the inner and outer box components. The upper edge of one side of the inner box component is cut away to slope downwardly to provide access to the corresponding upper corner of the film sheets and to thereby aid in the removal of the film sheets from the box. Lines of perforations are formed around the upper end portion of the inner box and at the level of the lower end of the downwardly sloping upper edge so that the upper end portion of the inner box may be easily removed to provide access to the entire width of the upper portions of the film sheets packaged in the box.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENT

Figure 2:
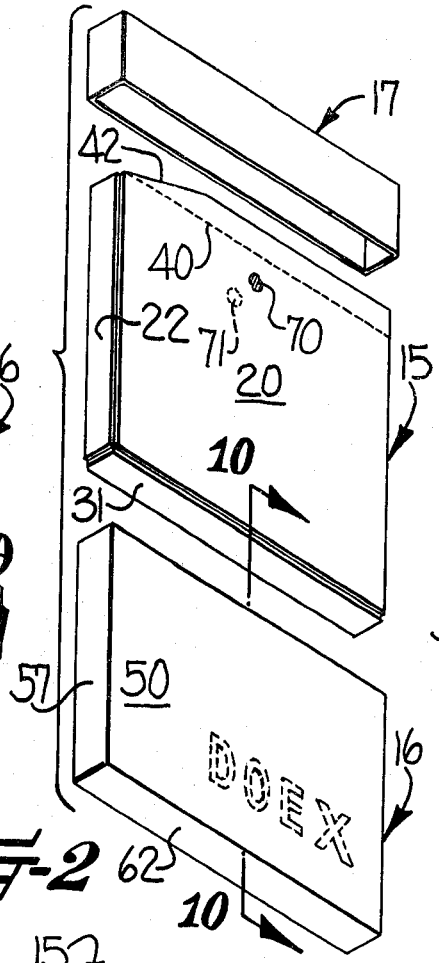
FIG. 2 is an exploded isometric view of the box.

As illustrated in the drawings, the present protective storage and dispensing box includes an inner box component, broadly indicated at 15, with an open upper end and a closed lower end. An outer box component, broadly indicated at 16, is provided and includes an open upper end which terminates below the level of the open upper end of the inner box component 15, and a closed lower end. A cap-type cover, broadly indicated at 17 (FIG. 2), is provided and includes a lower edge adapted to mate with the open upper end of the outer box component 16.

Figure 1:
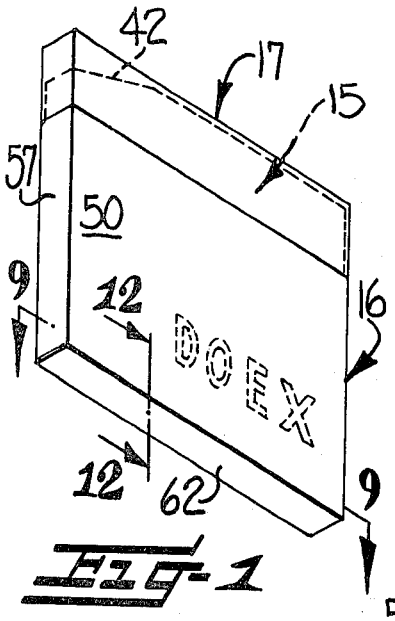
FIG. 1 is an isometric view of the completely assembled box of the present invention.
Figure 3:
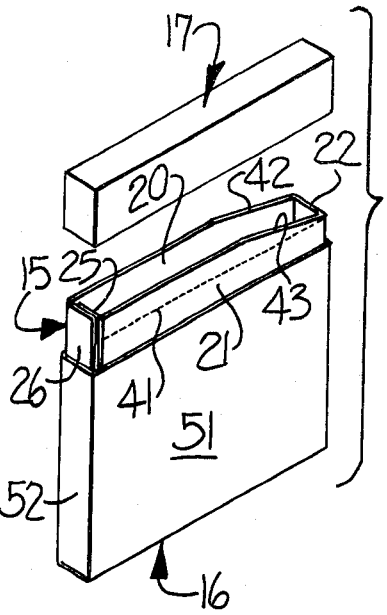
FIG. 3 is an isometric view of the side of the box opposite that shown in FIG. 1 and with the cap-type cover in a raised position.

The cover 17 surrounds and closes the open upper end portion of the inner box component 15 and may be raised to permit access to the film sheets in the box, as shown in FIG. 3, or lowered to the closed position shown in FIG. 1. The particular construction of the cap-type cover 17 is not particularly important to the present invention and is usually formed of a suitable weight of paperboard material and is usually provided with an overwrap of black paper adhered to the outer surface thereof to aid in excluding light from the interior of the box when the cover 17 is in the closed position shown in FIG. 1. However, it is important that the outer dimensions of the cover 17 be the same as the outer dimensions of the outer box component 16 so that a smooth joint is formed when the cover 17 is in closed position, as shown in FIG. 1. The uniform thickness throughout the length of the box provides for efficient stacking of the boxes on top of each other.

The inner box component 15 includes rectangular front and rear spaced-apart panels 20, 21 (FIGS. 4 and 5) with opposed sides and upper and lower edges. A first side panel 22 is positioned between the front and rear panels 20, 21 and its opposite side edges are joined along fold or cut lines 23, 24 to corresponding opposed sides of the front and rear panels 20, 21. A second side panel joins the opposite sides of the front and rear panels 20, 21 and includes first and second overlapped panel components 25, 26. The first side panel component 25 is joined to one side of the rear panel 21 along a fold or cut line 27 (FIG. 4) while the second side panel component 26 is joined to one side of the front panel 20 along a fold or cut line 28.

The bottom of the inner box component 15 includes first and second overlapped bottom panel components 30, 31 which are joined along fold or cut lines 32, 33 to the corresponding rear and front panels 21, 20. The first bottom panel 30 is provided with discontinuous perforations or indentations, indicated by the dotted lines 35 in FIG. 4, to provide better adherence of an adhesive material 34 provided on the inner surface of the second bottom panel 31 (FIG. 5) when the bottom of the box is formed in a manner to be presently described.

Figure 4:
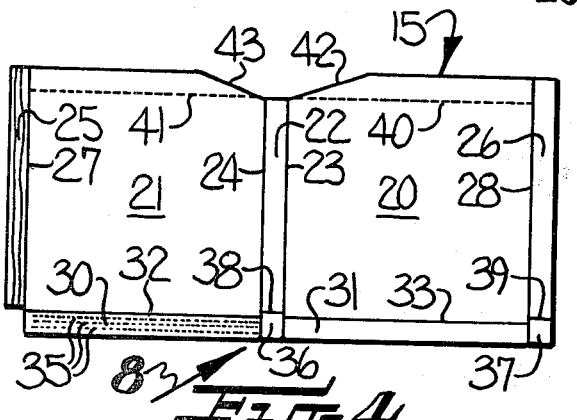
FIG. 4 is a view of the outside of the blank from which the inner box component is formed.
Figure 5:
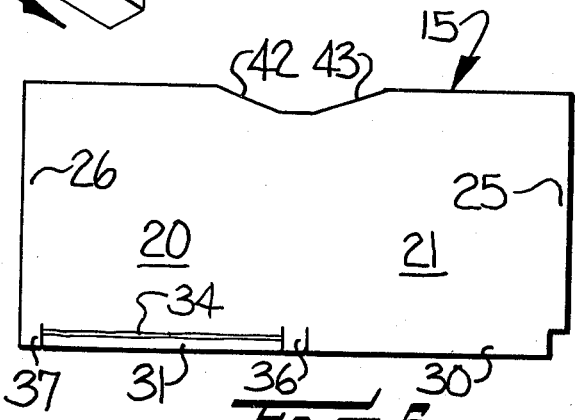
FIG. 5 is a view similar to FIG. 4 but showing the inside of the inner box component blank.

Bottom tabs 36, 37 are hingedly connected to the lower edges of the first side 22 and the second side panel component 26 (FIG. 4) as by respective fold or cut lines 38, 39. The upper edge portions of the front and rear panels 20, 21 are provided with respective lines of perforations 40, 41, shown as dotted lines in FIG. 4. The lines of perforations 40, 41 are at the same level as the upper edge of the first side panel 22 and permit the upper portions of the front and rear panels 20, 21 to be easily removed to provide access to the entire width of the upper portions of the film sheets packaged in the box, in a manner to be presently described. As illustrated in FIG. 4, the upper edges of the front and rear panels 20, 21 are provided with downwardly sloping portions 42, 43 which terminate at the same level as the upper edge of the first side panel 22. The downwardly sloping portions 42, 43 provide access to the corresponding upper corner of the film sheets in the box to aid in the removal of the film sheets therefrom.

The inner box component 15 is preferably formed of a heavy-weight material, such as 54-point plain chipboard laminated on each side with a 3-point black sky paper. The blank material, as illustrated in FIG. 4, is provided with fold or cut lines, illustrated at 23, 24, 27, 28, 32, 33 and 38, 39 which extend inwardly into the material substantially half the thickness thereof so that the corresponding panels on opposite sides of the cut lines are hingedly connected together and readily fold inwardly therefrom.

Figure 8:
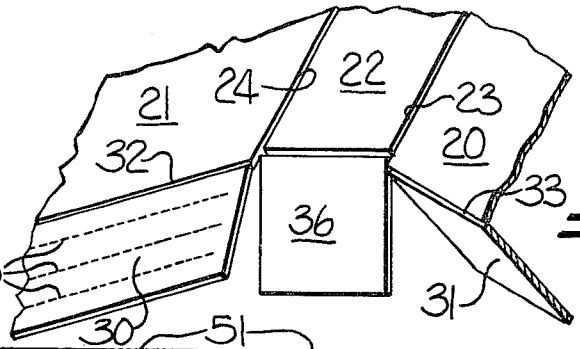
FIG. 8 is a fragmentary isometric view of the portion of the blank of the inner box component indicated by the arrow 8 in FIG. 4 and illustrating the blank in partially folded condition.
Figure 9:
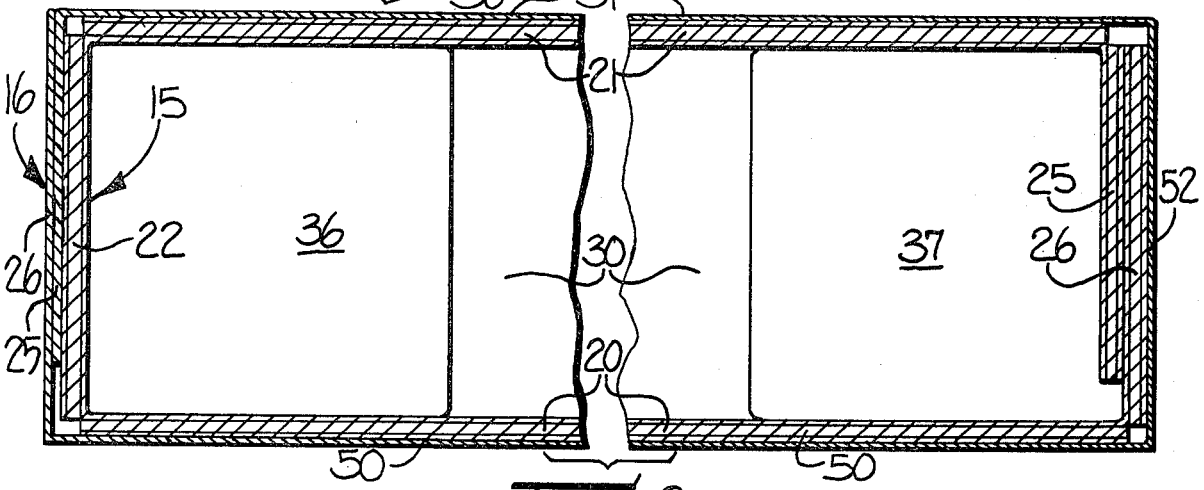
FIG. 9 is an enlarged horizontal sectional view taken substantially along the line 9—9 in FIG. 1.
Figure 10:
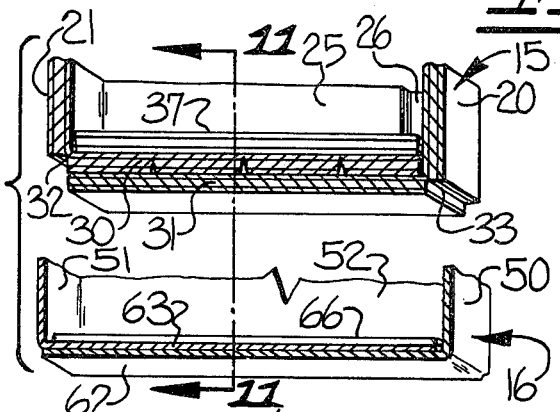
FIG. 10 is a fragmentary vertical sectional view taken substantially along the line 10—10 in FIG. 2.
Figure 11:
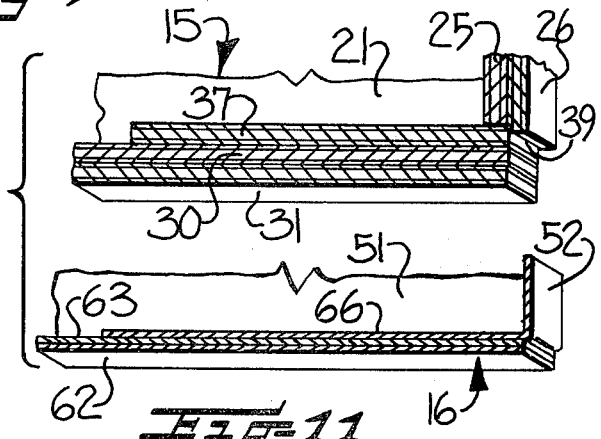
FIG. 11 is a vertical sectional view taken substantially along the line 11—11 in FIG. 10.
Figure 12:
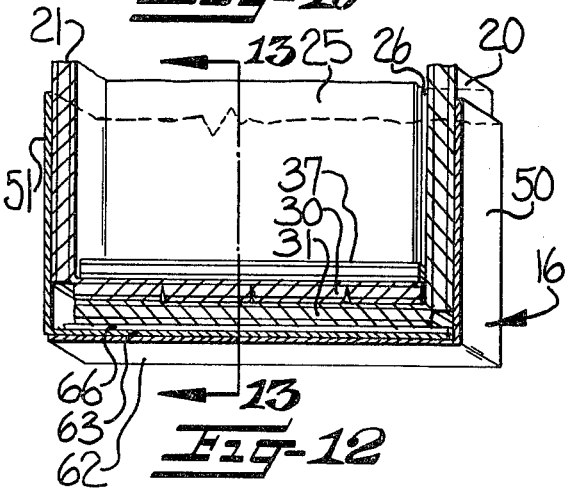
FIG. 12 is a vertical sectional view taken substantially along the line 12—12 in FIG. 1.
Figure 13:
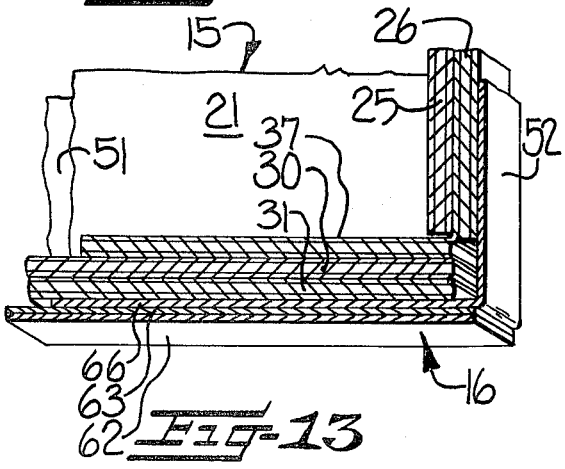
FIG. 13 is a vertical sectional view taken substantially along the line 13—13 in FIG. 12.

FIG. 8 illustrates the manner in which the panels are hingedly connected by the cut lines. In forming the inner box component 15, the tab 36 is folded inwardly into 90-degree relationship with the first side panel 22. The first bottom panel 30 is then folded inwardly into 90-degree relationship with the rear panel 21. The second bottom panel 31, with the adhesive bead 34 on the inner surface thereof, is folded inwardly into juxtaposition with the first bottom panel 30 and adhesively closed, as illustrated in the upper portion of FIG. 10. Since the inner box component 15 is formed with paper laminated to opposite sides thereof, the upper open edge or selected portions thereof which are subject to abrasion, may be bound with a suitable adhesive-type tape or by dipping in plastic so that the layers of paper will not peel back from the chipboard when the cap 17 is removed and replaced.

Figure 6:
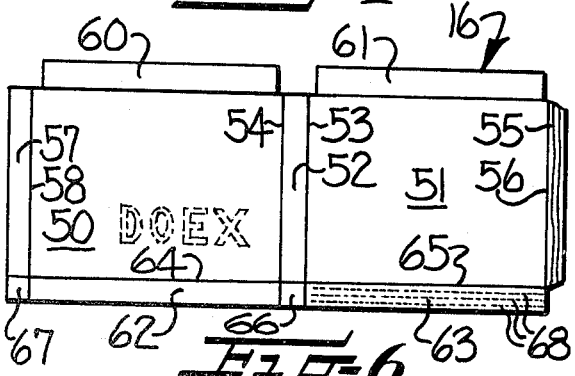
FIG. 6 is a view of the outside of the outer box component blanks.

The outer box component 16 includes rectangular front and rear spaced-apart panels 50, 51 with opposed sides and upper and lower edges. A first side panel 52 is joined along fold lines 53, 54 to the corresponding sides of the front and rear panels 50, 51 (FIG. 6). A second side panel is provided by a first side panel component 55 joined by a fold line 56 to the opposite side of the rear panel 51. A second overlapping panel component 57 is joined along one side to the other side of the front panel 50 along a fold line 58. Reinforcing panels 60, 61 are joined along fold lines to the upper edges of the respective front and rear panels 50, 51 and are adapted to be folded downwardly inside of the front and rear panels and adhesively secured thereto in order to reinforce the upper edge of the outer box component 16. The outer box component 16 also includes a closed bottom including first and second overlapped bottom panels 62, 63 joined to the lower edges of the respective front and rear panels 50, 51 by respective fold lines 64, 65. Bottom tabs 66, 67 are joined to the lower edges of the respective side panels 52, 57 along suitable fold lines and are adapted to be folded upwardly inside of the outer box component 16. It is preferred that the outer surface of the bottom panel 63, as shown in FIG. 6, be provided with discontinuous lines of perforation 68 to aid in causing an adhesive 69 on the bottom panel 62 to adhere to the bottom panel 63 when the bottom of the box is formed.

Figure 7:
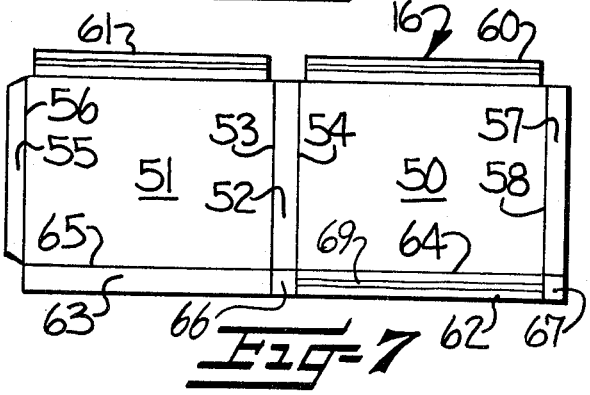
FIG. 7 is a view similar to FIG. 6 but showing the inside of the outer box component blank.

In forming the outer box component 16 from the blank shown in FIGS. 6 and 7, the reinforcing panels 60, 61 are folded inwardly and adhesively secured to the inner surfaces of the respective front and rear panels 50, 51. The side panel components 55, 57 are bent inwardly into 90-degree relationship with the respective front and rear panels 50, 51 in one direction and adhesively secured together to complete the rectangular condition of the outer box component 16. The bottom tabs 66, 67 are folded upwardly into 90-degree relationship with the respective panels 52, 57 and the bottom panels 62, 63 are folded inwardly into 90-degree relationship with the corresponding front and rear side panels 50, 51 and adhesively secured together to close the bottom of the outer box component 16. The outer box component 16 is preferably formed of a 24-point solid bleached sulfate paperboard and the outer surface may be suitably imprinted with any identifying indicia, such as that illustrated in dotted lines in FIGS. 1. 2 and 6, for purposes of identifying the manufacturer and other information, such as the type of film which may be provided in the box.

The inner and outer box components 15, 16 are so dimensioned that the inner box component 15 will slip into and fit tightly within the outer box component 16. The inner box component 15 is adhesively secured inside of the outer box component 16, as by applying spots of glue or adhesive, indicated at 70, 71 in FIG. 2 so that the adhesive is positioned between the front and rear panels 20, 21 of the inner box component 15 and front and rear panels 50, 51 of the outer box component 16 when the inner box component 16 is nested within the outer box component 16.

Thus, the folding carton box components 15, 16 are married to make a set-up box. The upper edge of the first side panel 22 is positioned substantially midway between the level of the upper edges of the front and rear panels 20, 21 and the upper edges of the front and rear panels 50, 51 so that the cap 17 remains in closed position on the upper end portion of the inner box component 15, even with the downwardly sloping portions 42, 43 being provided.

Figure 14:
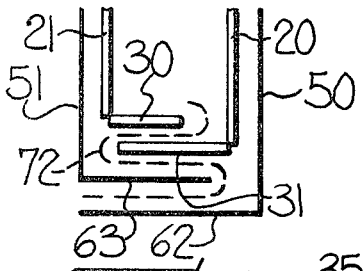
FIG. 14 is an exploded schematic sectional view through the bottom of the box illustrating the manner in which the bottom panels are folded and overlap each other.

As schematically illustrated in FIG. 14, the bottom panels 30, 31 of the inner box component 15 and the bottom panels 62, 63 of the outer box component 16 are joined along fold lines to the respective front and rear panels 20, 21 and 50, 51 and preferably overlapped in the same manner. Thus, the bottom panels are alternately joined by fold lines to the front and rear panels to provide a sinuous path, indicated by the dotted line 72 in FIG. 14, for any light entering the box through the bottom to thereby aid in excluding light from the interior of the box.

The inner box component 15 is formed of a heavy-weight and thick chipboard while the outer box component 16 is formed of a light-weight and thin bleached sulfate paperboard. The chipboard forming the inner box component 15 is a cheaper grade but is greter than two times as heavy and thick as the more expensive grade of paperboard of which the outer box component 16 is formed. When these two components are joined together, the resulting set-up box is very rigid and durable but is produced at a reduced cost.

The cap-type cover 17 is formed of a suitable weight material so that when it is in the closed position on the upper end of the inner box component 15, as shown in FIG. 1, the outer length and width dimensions are the same as the outer length and width dimensions of the upper portion of the outer box component 16 which is positioned adjacent thereto. This provides a smooth juncture or joint around the upper end of the box where the cover 17 and the outer box component 16 join each other and provides uniform thickness throughout the length and width of the box for the efficient stacking of a plurality of the boxes on top of each other.

The two-component box provides the advantages of greater rigidity, reduced cost of construction and manufacture and the construction of the box provides for exclusion of light from the interior of the box. The construction and the manner in which the side and bottom panels of the inner and outer box component 15, 16 are overlapped also adds rigidity to the box and aids in excluding light from entry to the interior of the box. The film box may be formed in various dimensions so that various numbers and sizes of film sheets can be packaged therein. The rigid and durable construction of the box permits the packaging of a large number of large size X-ray film sheets, for example 100 sheets of 14×17 inch film, which weigh approximately ten pounds.

In the drawings and specifications there has been set forth the best mode presently contemplated for the practice of the present invention, and although specific terms are employed, they are used in a generic and descriptive sense only and not for purposes of limitation, the scope of the invention being defined in the claims.

That which is claimed is:

1. A protective storage and dispensing box for flexible sheets of light-sensitive material, such as X-ray film sheets, said box including an inner box component with an open upper end and a closed lower end, an outer box component closely surrounding and engaging said inner box component, said outer box component including an open upper end terminating below the level of the open upper end of said inner box component and a closed lower end, and a cap-type cover including a lower edge adapted to cooperate with the open upper end of said outer box component, said cover surrounding and closing the open upper end portion of said inner box component, said inner box component including rectangular front and rear spaced-apart panels with opposed sides and upper and lower edges, a first side panel including opposed sides joined along fold lines to corresponding sides of said front and rear panels, a second side panel including first and second overlapped panel components, a bottom including first and second overlapped bottom panels joined along fold lines to said front and rear panels, downwardly sloping portions on said upper edges of said front and rear panels of said inner box component, said first side panel of said inner box component including an upper edge positioned at the juncture of said downwardly sloping portions of said upper edges of said front and rear panels of said inner box component, said downwardly sloping portions and said upper edge of said first side panel of said inner box component providing exposure of the corresponding upper corner of the film sheets to thereby aid in the removal of the film sheets from said box, and lines of perforations formed in said front and rear panels of said inner box and spaced below said upper edge of said front and rear panels and at the same level as the upper edge of said first side panel so that the upper portions of said front and rear panels of said inner box may be easily removed to provide access to the entire width of the upper portions of the film sheets packaged in said box, said outer box component including rectangular front and rear spaced-apart panels with opposed sides and upper and lower edges, a first side panel including opposed sides joined along fold lines to corresponding opposed sides of said front and rear panels, a second side panel including first and second overlapped panel components, and a bottom including first and second overlapped bottom panels joined along fold lines to said front and rear panels, said bottom panels of said inner and outer box components being overlapped in the same manner so that said bottom panels are alternately joined by fold lines to said front and rear panels to provide a sinuous path for any light entering the box through the bottom to thereby aid in excluding light from the interior of said box.

2. A box according to claim 1 wherein said second overlapped side panel of said inner box component is positioned on one side of said box, and said second overlapped side panel of said outer box is positioned on the other side of said box.

3. A box according to claim 1 including adhesive means securing said inner box component to said outer box component.

4. A box according to claim 3 wherein said adhesive means is positioned between said front and rear panels of said inner and outer box components.

5. A box according to claim 1 wherein said upper edge of said first side panel of said inner box component is positioned above the level of said upper edges of said front and rear panels of said outer box component and below the level of said upper edge of said second side panel of said inner box component.

6. A box according to claim 5 wherein said upper edge of said first side panel of said inner box component is positioned substantially midway between the level of said upper edges of said front and rear panels of said outer box component and said upper edge of said second side panel of said inner box component.

7. A box according to claim 1 wherein said inner box component is formed of material at least two times as heavy and thick as the material of said outer box component.

8. A box according to claim 7 wherein said fold lines of said inner box component comprise cut lines extending inwardly into the material at least half the thickness thereof so that the corresponding panels are hingedly connected to said front and rear panels and readily folded inwardly therefrom.

* * * * *